United States Patent [19]

Williams

[11] Patent Number: 4,742,736

[45] Date of Patent: May 10, 1988

[54] BAND CLAMP PLIERS

[75] Inventor: Danny L. Williams, Clarinda, Iowa

[73] Assignee: Lisle Corporation, Clarinda, Iowa

[21] Appl. No.: 899,247

[22] Filed: Aug. 22, 1986

[51] Int. Cl.[4] ..... B25B 7/02

[52] U.S. Cl. ..... 81/303; 81/304; 81/307; 81/309

[58] Field of Search ..... 81/308, 309, 303, 304, 81/307, 9.3, 427.5; 294/87

[56] References Cited

U.S. PATENT DOCUMENTS

| | | | |
|---|---|---|---|
| 1,250,690 | 9/1917 | Stallings | 81/309 |
| 1,442,083 | 1/1923 | Meyer | 81/427.5 |
| 3,216,291 | 11/1965 | Madeira | 81/309 |

OTHER PUBLICATIONS

Applicant's Specification, p. 5, paragraph one, and FIG. 5.

*Primary Examiner*—Frederick R. Schmidt
*Assistant Examiner*—Maurina Rachuba
*Attorney, Agent, or Firm*—Allegretti, Newitt, Witcoff & McAndrews, Ltd.

[57] ABSTRACT

Disclosed is a pliers for contracting CV boot band clamps having crossed lever arms, with each lever arm having a jaw at one end, a grippable handle at the other, and a drive socket between the handle and jaw. The pliers also has a thrust plate with an anvil that moves toward the jaws as they are brought together by closing the pliers.

12 Claims, 2 Drawing Sheets

BAND CLAMP PLIERS

BACKGROUND OF THE INVENTION

This invention relates to an improved pliers for contracting band clamps. More specifically, this invention relates to pliers for contracting differing types of band clamps used to seal different types of sealing boots (such as constant velocity boots) around assemblies (such as a front wheel drive shafts) on which the boots are mounted.

Front wheel drive vehicles have long employed a special joint, the "constant velocity" or "CV" joint, to transmit rotation of a transaxle driven by an engine into rotation of the front, steerable wheels of the vehicle. The joint is called a CV joint because it ensures that, when the engine crank shaft rotates at a constant speed, the wheels rotate at a constant speed even as they are turned to steer the vehicle.

The CV joint is a fairly complicated assembly of drive shaft, cage, race bearings, ball bearings, output shaft, and lubricants. It must work smoothly and with minimum friction.

To keep dirt and other contaminants out of the joint and to retain lubricants, a flexible plastic or rubber boot or sleeve is mounted over the joint to seal the intersection of the joint and the axle or drive shaft. The boot has a complex tubular shape and encircles the CV joint. At least one end of the boot is retained on the CV joint by means of a band clamp. Thus, the CV band clamp is also circular to clamp the boot to the cylindrical shaft or housing of the CV joint.

There are several different types of CV boot clamps, which contract or tighten around the boot in various manners. Typically, however, CV boot clamps are applied about a CV boot and compressed against the boot by collapsing or folding over a portion of the clamp to reduce the circumference of the clamp against the periphery of the boot and thereby retain the boot on the CV joint or shaft.

Today, there are three prevalent ear types of boot clamps:

1. a normal duty ear clamp having two protruding ears on either side of a single "offset" or protrusion in the periphery of the clamp; a special clamp pliers grips the surface of the ears, and by compressing them together, reduces the circumference of the clamp;

2. normal duty ear clamps with a dimple in each ear; a special clamp pliers having a pin in each jaw penetrates the opposing dimples, and by closing the jaws, the offset collapses or compresses between the ears; and 3. extra heavy duty ear clamps that require compressing the offset by a specific, high torque reading.

Two such speciality pliers used to effect compression or diameter reduction of the CV boot clamp are (i) the hand operated pliers disclosed in U.S. Pat. No. 3,216,291, and (ii) the socket pliers shown in FIG. 5 of this specification.

The pliers disclosed in U.S. Pat. No. 3,216,291 ("the '291 pliers") are hand operated. Closing the '291 pliers by hand causes jaws to grip the sides of the offset and effect compression, thereby reducing the diameter of the band clamp. At the same time, as the jaws compress the offset, an anvil rams the compressed offset radially inwardly to form a T-shaped fold in the band. Such a T-shaped fold is usually stronger than an offset collapsed by jaws without radially ramming the offset with the anvil.

Another prior art tool is the socket pliers shown as "Prior Art" in FIG. 5 of this application. This tool does not have a thrust plate and is not hand operable to adequately and securely compress a band clamp about a CV-boot. Rather it is used to compress band clamps in conjunction with other tools.

The socket pliers is comprised of crossed arms, with a washer separating the arms at their intersection. Each arm has a socket in the end opposite the jaw. Each socket is reinforced with a square apertured reinforcing plate welded to each arm over the socket. The socket aperture is thus deepened or extended by the reinforcing plate.

To use the tool, a breaker bar is attached in the socket in one arm, and a torque wrench is attached in the other socket in the opposing arm. By forcing the breaker bar and torque wrench toward each other, the operator can apply a relatively high and measured amount of torque to compress the clamp against the boot.

Neither of these prior art tools is adequate for use as both a hand operated and torque-wrench-driven CV boot clamp pliers. Moreover, while the socket pliers tool is designed for torque-wrench operation, it does not provide any mechanism of ramming the offset as it is compressed between the jaws of the pliers. On the other hand, the '291 hand-operated tool provides a ramming mechanism but cannot be used to clamp at high specific torque readings and does not have any washer between the plier arms to reduce wear between the lever arms in high torque applications.

It is thus an object of the present invention to provide a unitary tool that can be alternatively hand operated or torque-wrench operated to compress a wider variety of boot clamps.

It is yet another object to provide such a tool that provides a mechanism for ramming the clamp offset radially as it is compressed between the jaws of the pliers. A still further object is to provide such a mechanism that also serves the function of a washer between the lever arms.

An additional object of this invention is to have a hand operable boot clamp pliers utilizing an economical lever arm that is light weight and reinforced and strengthened to accommodate a torque wrench or breaker bar.

Another object is to provide such a lever arm that is constructed of two sections joined together to define a reinforced and strengthened socket capable of receiving a torque wrench or breaker bar.

Yet another object is to provide an improved clamp pliers which is inexpensive, desirable, and easy to operate. These and other objects, advantages and features are described herein.

SUMMARY OF THE INVENTION

Briefly, the present invention comprises an improved CV boot clamp pliers having first and second pivotally connected lever arms, each arm including a jaw at one end, a grippable handle at the other, and a socket between the jaw and handle. The pliers also have a thrust plate slidably mounted on the pivot pin connecting the arms. The thrust plate includes an anvil which cooperates with the jaws to compress a boot clamp into a desired configuration. The thrust plate is driven in response to a camming mechanism associated with movement of the lever arms so that as the jaws close the anvil moves towards the closed jaws.

DETAILED DESCRIPTION OF THE DRAWINGS

The preferred embodiments of the present invention and the prior art socket pliers are both illustrated in the accompanying drawings wherein.

DETAILED DESCRIPTION OF THE PREFERRED EMBODIMENT

Figure 1:
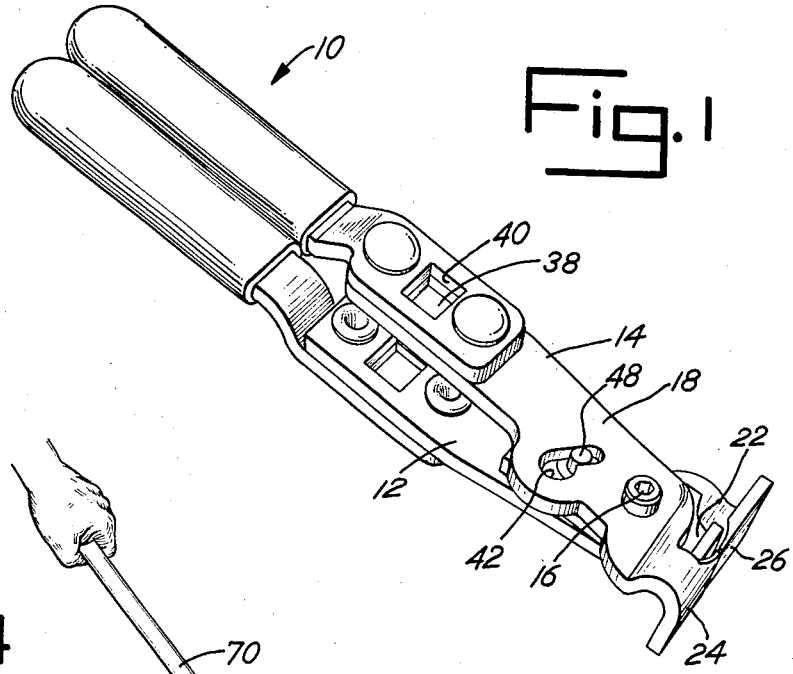
FIG. 1 is a perspective view of the preferred embodiment when the pliers are closed.

Referring first to FIG. 1, the pliers 10 has two complementary, crossed lever arms 12, 14 pivotally connected by a pivot pin 16. Movement of the lever arms 12, 14 about the pivot pin 16 operates a cam mechanism which forces a thrust plate 22 to move either toward or away from complementary jaws 24, 26 at the end of the lever arms 12, 14 as the arms 12, 14 are moved together or apart, respectively.

Figure 2:
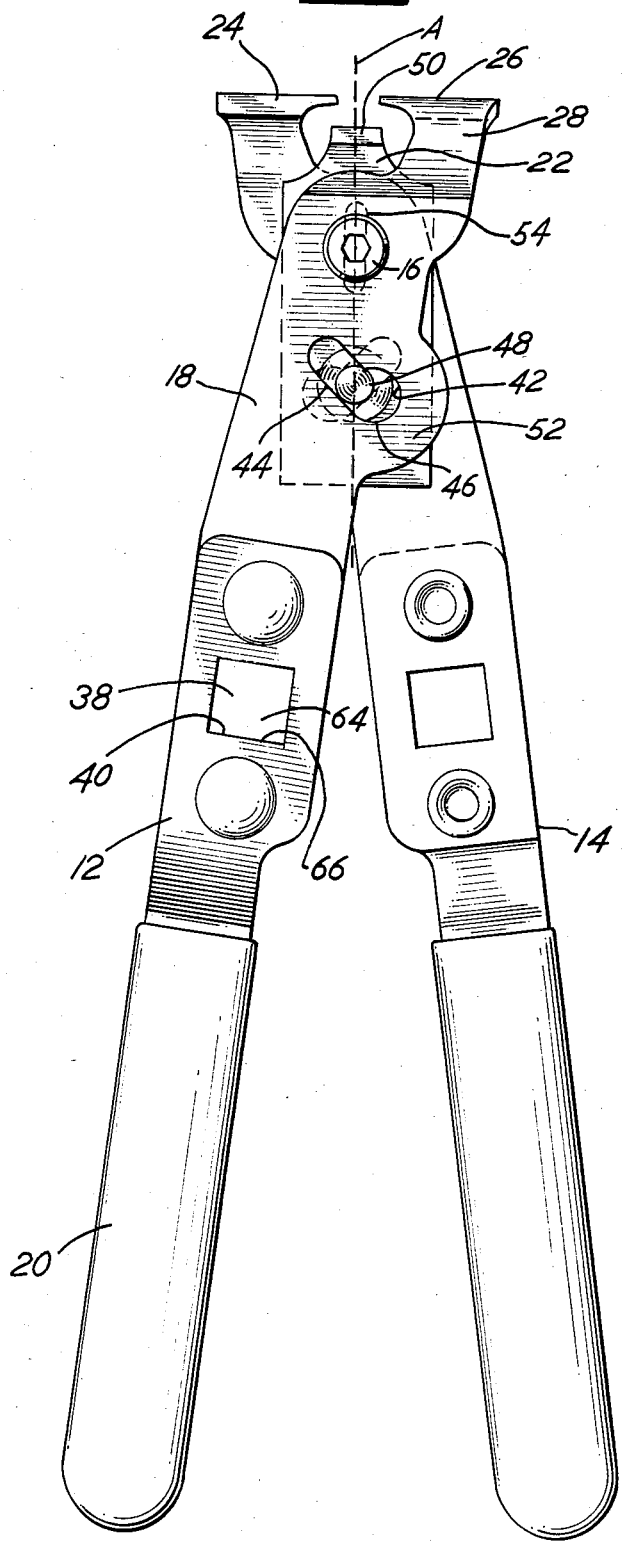
FIG. 2 is a plan view of the preferred embodiment when the pliers are somewhat open.
Figure 3:
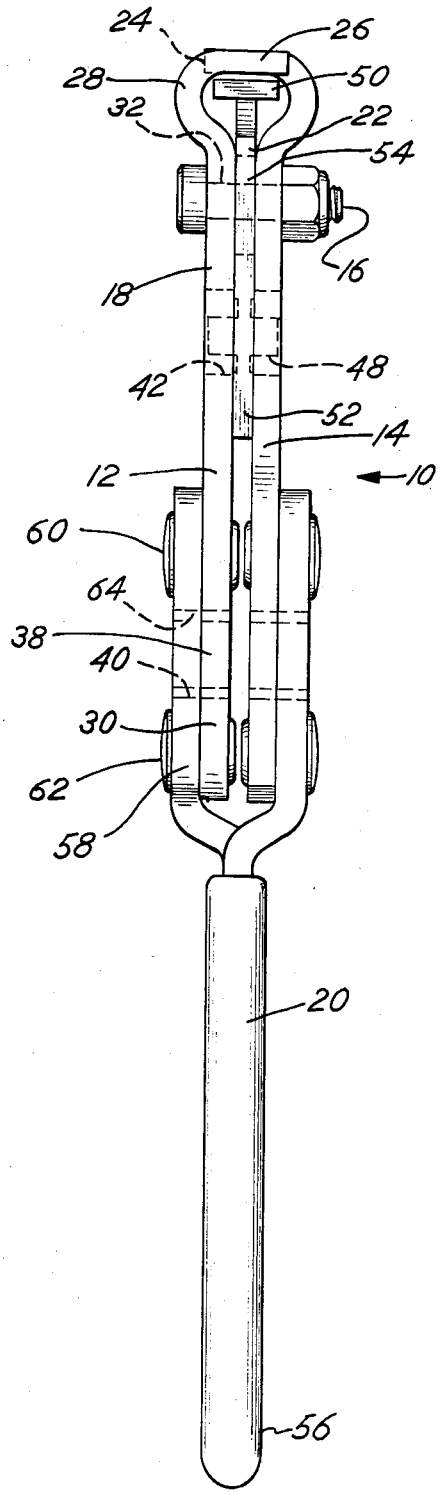
FIG. 3 is a side plan view of the preferred embodiment when the pliers are somewhat opened.

Referring now to FIG. 3, each lever arm 12, 14 has a jaw member 18 attached to, and overlaying, a handle extension 20. Each jaw member 18 has a jaw 28 opposite a driving end 30. A pin passage 32 is provided in the opposed jaw members 18 for receipt of the pivot pin 16 connecting the two lever arms 12, 14. Each jaw member 18 also has a socket passage 38 in the driving end 30 and a camming recess 42 intermediate the socket passage 38 and the pin passage 32. As shown in FIG. 2, the socket passage 38 is a multisided (in this case a four sided or square) opening 40 and, as shown in FIG. 3, passes entirely through the driving end 30. Similarly, the camming recess or channel 42 passes entirely through the member 18 adjacent the pin passage 32.

Referring again to FIG. 2, the camming recess 42 is comprised of an elongated slot 44 connected with a circular passage 46. Slot 44 defines a longitudinal axis 45 which forms an acute angle B to a longitudinal axis 47 of the lever arm 12. When the arms 12, 14 are pivotally connected, the slots 44 in each of the respective lever arms 12, 14 are positioned at ninety degree angles to each other and overlie each other. Each slot 44 and passage 46 form a camming surface to guide a follower rod 48 extending laterally from the thrust plate 22. Rod 48 extends transversely in opposite directions from the surface of plate 22 into each channel 42 of each arm 12, 14 and simultaneously is engaged by the associated camming surface to simultaneously drive the thrust plate 22.

The thrust plate 22 is comprised of (i) a planar plate 52 coplanar with, and interposed between, the arms 12, 14, and (ii) an anvil 50 extending transversely from the plate 52 between the pivot pin 16 and jaws 24, 26. The thrust plate 22 includes an elongated pin slot 54 having a longitudinal axis 47. The pivot pin 16 extends through pin slot 54. The pin slot 54 in cooperation with pivot pin 16 provides a guide for sliding movement of the thrust plate 22.

Referring now to FIGS. 2 and 3, each jaw 24, 26 has an arcuate section 51 terminating in a planar jaw tooth 53. The axis of the arcuate section 51 is transverse to the axis of the pivot pin 16, and the arcuate section 51 thus provides a passage 55 for sliding movement of the anvil 50 between the pivot pin 16 and jaw tooth 53.

Rotation of the handle extensions 20 toward each other drives the intersection of the camways 42, and thus the plate 22, toward the pivot pin 16 and jaws 24, 26. Rotation of the handle extensions 20 away from each other moves the intersection of the camways 42 and thrust plate 22 away from the pivot pin 16 and jaws 24, 26.

As a result, as shown in FIG. 2, the follower rod 48 simultaneously cooperates with the camway 42 of each pivot arm 18 and moves in a path defined by the intersection of the two camways 42. Moreover, since the follower rod 48 is affixed to the thrust plate 22 positioned between the lever arms 12, 14, movement of the follower rod 48 in the camways 42 translates into movement of thrust plate 22 in the direction of movement of the follower rod 48. Simultaneously, the camway 42 cooperatively ensures that, as the thrust plate 22 is driven by the follower rod 48 moving in the elongated slot 44, the entire thrust plate 22 also moves along axis 47 passing through the axial center of the pivot pin 16 and a point midway between the two complementary jaws 24, 26. However, the passage 46 permits limited movement of the follower rod 48 in the camway 42 without engaging the rod 48 after the rod 48 has traveled the length of the elongated slot 44.

The net result is that, as the handle extensions 20 of the lever arms 12, 14 are rotated about the pivot pin 16 toward each other, the camways 42 cooperatively drive the follower rod 48, and thereby the thrust plate 22, along the axis 47. At the same time, the same relative rotation of the handles 20 moves the jaws 24, 26 toward each other along a circumferential path at a constant radius from the axis of the pivot pin 16. The jaws 24, 26 thus collapse an offset 100 as the anvil 50 rams the offset 100 to create a strong T-shaped fold 102 in the offset 100.

Similarly, as the handles 20 are rotated about the pivot pin 16 away from one another, the elongated slots 44 cooperatively drive the follower rod 48, thrust plate 22, and anvil 50 along same axis 47 but with the anvil 50 moving radially inwardly toward the axis of the pivot pin 16. Simultaneously, the jaws 24, 26 move away from each other along the circumferential path at a constant radius from the axis of the pivot pin 16.

However, at the intersection of the elongated slots 44 with the circular passage 46, rotation of the handles 20 away from each other does not drive the follower rod 48 within the expanded periphery of the passage 46; and upon contact of the follower rod 48 with the passage 46, the follower rod 48 cooperatively serves as a stop means to prevent further rotation of the handles 20 away from each other. All the while, the thrust plate 22 also serves the function of a flat washer to reduce friction and wear between the intersection of the lever arms 12, 14 about the pivot pin 16.

Figure 4:
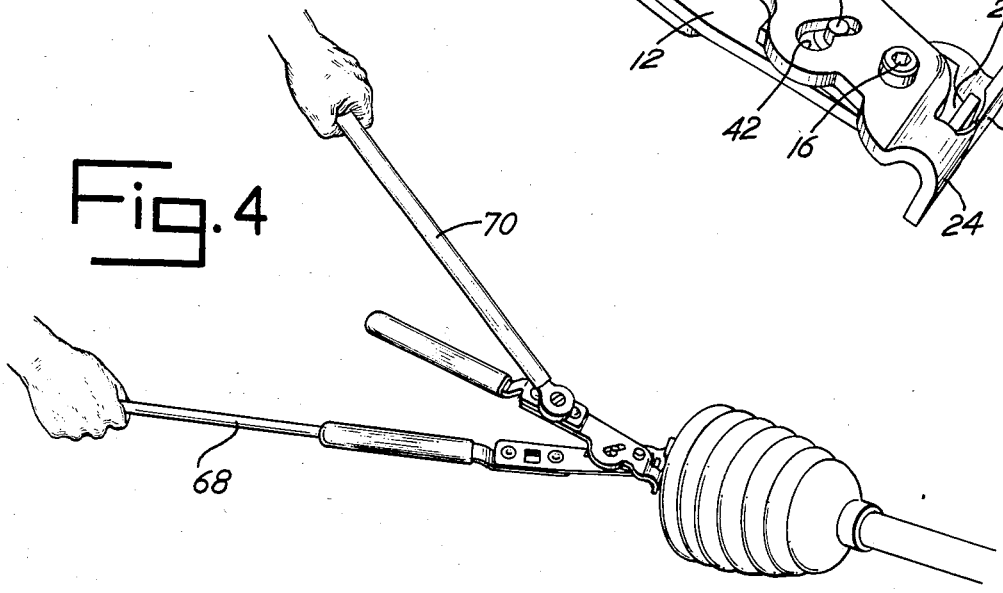
FIG. 4 is a perspective view of the preferred embodiment as used with a torque wrench and breaker bar to contract a CV boot clamp.
Figure 5:
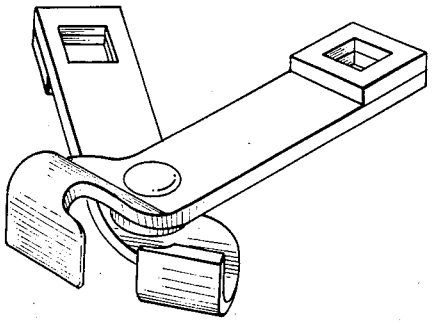
Fig. 5 (PRIOR ART)
FIG. 5 is a perspective view of the prior art socket CV boot pliers.

Referring back to FIG. 3, the handle extension 20 has a plastic grip 56 on one end opposite a socket reinforcing end 58 on the other. Reinforcing end 58 includes a passage 64 coincident with passage 38. As shown in FIG. 2, the reinforcing end 58 of the handle 56 is riveted to the driving end 30 of the pivot arm 18 with two rivets 60, 62. Rivets 60, 62 are fastened on opposite sides of reinforcing passage 64 which overlies passage 38. The reinforcing passage 64 has a square shape and coincides with the socket passage 38 on the pivot arm 18 to provide a unitary driving socket for cooperation with either a breaker bar 68 or torque wrench 70, such as shown in FIG. 4.

In the preferred embodiment, the driving section 18 and handle extension 20 are made of 1050 cold rolled steel. The thrust plate 22 consists of 6061-T6 aluminum, and the follower guide is comprised of 11L41 cold finished steel.

The preferred embodiment 10 provides an economical, easily manufactured, and lightweight unitary CV boot clamp pliers, which can be used to contract any of the ear type boot band clamps. The preferred embodiment provides a thrust plate to (i) ram an anvil into the clamp offset as it is collapsed by the jaws and (ii) simultaneously serve as a washer between the lever arms. The sockets in the lever arms are reinforced by the handle section to provide a sufficiently deep and strong socket for use in combination with a torque wrench or breaker bar, and yet the handles on the handle sections are conveniently located and easily grippable to bring the jaws together and ram the anvil forward by merely closing the pliers by hand.

While in the foregoing there has been a detailed description of the preferred embodiment, it is to be understood that the scope of the invention is to by measured by the following claims rather than the foregoing detailed description.

What is claimed is:

1. Clamp pliers for compressing a band clamp of the type having a T-shape fold, the pliers comprising in combination:

(a) first and second lever arms, each arm having a clamp engaging jaw at one end, a manually grippable handle at the other end, and a socket intermediate the jaw and handle;

(b) a pivot pin connecting the arms intermediate the socket and jaw whereby the jaws are maintained in opposed alignment;

(c) a thrust plate slidably mounted on the pivot pin, the thrust plate including an anvil generally traverse to the axis of the pin and positioned for movement radially toward and away from the pin between the jaws; and (d) cam means including (i) a camway in each lever arm and (ii) a single follower pin portion having opposed axially aligned pin sections projecting from both sides of the thrust plate and cooperatively engaging the camways, whereby as the arms are pivoted about the pivot pin to move the jaws together, the camways drive the follower pin radially toward the jaws.

2. The clamp pliers of claim 1 wherein (i) the thrust plate includes a planar member slidably positioned between the lever arms and (ii) the anvil extends from the planar member transverse to the plane of planar member between the jaws and pivot pin.

3. The clamp pliers of claim 2 wherein each of the jaws include an arcuate section terminating in a planar jaw tooth, the axis of the arcuate section being transverse to the axis of the pivot pin to provide a passage for sliding movement of the anvil between the pivot pin and planar jaw section.

4. The clamp pliers of claim 1 or 3 wherein the socket in each of the lever arms is formed of joined and layered members having a passageway at the junction of the members, the junction defining a thickened portion in the lever arm and the passageway providing a reinforced socket adapted to receive a torque wrench.

5. The clamp pliers of claim 4 wherein the camway in each lever arm comprises a sloted portion terminating in an expanded end permitting movement of the lever arm in the expanded portion without engaging the follower projecting from the thrust plate.

6. The clamp pliers of claim 5 wherein the slotted portion in the camways cooperatively engage the follower whereby relative rotation of the lever arms drives the follower radially toward the jaws on the lever arms.

7. Clamp pliers for compressing a band clamp of the type having a T-shaped fold, the pliers comprising in combination:

(a) first and second lever arms, each arm having a clamp engaging jaw at one end, a manually grippable handle at the other end, and a socket intermediate the jaw and handle;

(b) a pivot pin connecting the arms intermediate the socket and jaw whereby the jaws are maintained in opposed alignment;

(c) a thrust plate slidably mounted on the pivot pin, the thrust plate including an anvil generally transverse to the axis of the pin and positioned for movement radially toward and away from the pin between the jaws; and (d) cam means including (i) a camway in each lever arm and (ii) two follower pin portions axially aligned on opposite sides of the thrust plate cooperatively engaging the camways, whereby as the arms are pivoted about the pivot pin to move the jaws together, the camway drive the follower pins radially toward the jaws.

8. The clamp pliers of claim 7 wherein (i) the thrust plate includes a planar member slidably positioned between the lever arms and (ii) the anvil extends from the planar member transverse to the planar member between the jaws and pivot pin.

9. The clamp pliers of claim 8 wherein each of the jaws include an arcuate section terminating in a planar jaw tooth, the axis of the arcuate section being transverse to the axis of the pivot pin to provide a passage for sliding movement of the anvil between the pivot pin and planar jaw section.

10. The clamp pliers in claims 7 or 9 wherein the socket in each of the lever arms is formed of joined and layered members having a passageway at the junction of the members, the junction defining a thickened portion in the lever arm and the passageway providing a reinforced socket adapted to receive a torque wrench.

11. The clamp pliers of claim 10 wherein the camway in each lever arm comprises a slotted portion terminating in an expanded end permitting movement of the lever arm in the expanded portion without the follower projecting from the thrust plate.

12. The clamp pliers of claim 11 wherein the slotted portion in the camways cooperatively engages the followers whereby relative rotation of the levers arms drives the follower radially toward the jaws on the lever arms.

* * * * *